US006748904B1

(12) United States Patent
Chiang

(10) Patent No.: US 6,748,904 B1
(45) Date of Patent: Jun. 15, 2004

(54) STEAM PRODUCER CAPABLE OF PERFORMING DUAL HEATING PROCESSES

(76) Inventor: Li-Yuan Chiang, 5F, No. 607-1, Shinshu Rd., Shinjuang, Taipei (TW)

( * ) Notice: Subject to any disclaimer, the term of this patent is extended or adjusted under 35 U.S.C. 154(b) by 0 days.

(21) Appl. No.: 10/647,315

(22) Filed: Aug. 26, 2003

(51) Int. Cl.[7] ..... F22B 27/14
(52) U.S. Cl. ..... 122/40; 122/379
(58) Field of Search ..... 122/379, 40, 41, 122/408.1, 452; 392/399, 405, 406; 134/148, 151

(56) References Cited

U.S. PATENT DOCUMENTS 2,604,957 A * 7/1952 Williamson et al. ..... 55/413
6,299,076 B1 * 10/2001 Sloan et al. ..... 239/136

* cited by examiner

*Primary Examiner*—Gregory A. Wilson

(57) ABSTRACT

A steam producing device capable of performing dual heating processes includes an outer shell, and a heating member inserted in, and secured to the outer shell; the heating member has a steam room, and forms a first, a second, and a third chamber together with an inner side of the outer shell; the second chamber communicates with the first chamber owing to a gap, and communicates with the third chamber owing to a narrow curved passage between the heating member and the outer shell; a hole is formed on the heating member for the steam room to communicate with the third chamber; thus, water, after flowing into the first chamber, can travel through the chambers to go through one heating process, and then travel through the steam room to go through another heating process to be transformed into steam and discharged outside the shell for use.

2 Claims, 7 Drawing Sheets

STEAM PRODUCER CAPABLE OF PERFORMING DUAL HEATING PROCESSES

BACKGROUND OF THE INVENTION

1. Field of the Invention

The present invention relates to a steam producing device for use with a steam cleaning apparatus, more particularly one, which is made in such a manner that water therein will go through dual heating processes, and which is free from the risk of explosion.

2. Brief Description of the Prior Art

Steam cleaning apparatuses are becoming popular recently, which are equipped with steam producing devices, and can eject steam produced by steam producing devices onto various objects to remove dirt, kill bacteria plus increase humidity.

Referring to FIGS. 6 and 7, a conventional steam producing device 2 of steam cleaning apparatus includes a water tank 24, a pump 23 connected to the water tank 24 by means of a conduit 244, and a steam producer 21 connected to the pump 23 by means of a duct 233; water is made to travel from the tank 24 through a water inlet 213 of the steam producer 21 by means of the pump 23. The steam producer 21 consists of a housing 211, and a heating pipe 212 disposed in the housing 211; the heating pipe 212 is connected to conducting members 218 disposed outside the housing 211 so that it can be powered to produce heat for transforming water into steam rapidly.

In order for steam to stay in the housing 211 for extended length of time so that pressure of the steam can be increased, the housing 211 is divided into a steam producing chamber, a transitional chamber 225, and a steam ejection chamber 222; the steam producing chamber is divided into a main chamber 224, and a subsidiary chamber, which is further divided into first, second, third, and fourth chambers 214, 215, 216, and 217 of the same size by means of disposing separating boards 221 in between; the main chamber 224 is half the size of the whole steam producing chamber; the separating boards 221 have steam passages 223. A steam outlet 219 is provided between the fourth chamber 217 and the transitional chamber 225 while a steam outlet 220 is provided between the transitional chamber 225 and the steam ejection chamber 222. And, the steam ejection chamber 222 is provided with several steam ejection outlets 22, which are equidistantly spaced so that steam can be ejected uniformly.

Water will become steam very rapidly after having passed into the main chamber 224 via the water inlet 213 because of the heating pipe 212. And, steam in the main chamber 224 has to pass through the chambers 214, 215, 216, and 217 via the passages 223 of the separating boards 221, and then pass into the transitional chambers 225 from the fourth chamber 217 via the steam outlet 219, and pass from the transitional chambers 225 into the ejection chamber 222 via the outlet 220 before it can be ejected from the ejection outlets 22 therefore the length of time is extended wherein steam travels through the housing 211. Consequently, pressure of steam in the steam producer 21 becomes relatively high with steam being constantly produced.

The steam producing device 2 can transform water therein into steam very rapidly, and increase pressure of steam for the same to be discharged outside the outlets 22 at high speed to remove dirt, and kill bacteria effectively.

However, the steam producing device 2 can only perform single heating cycle therefore the heating capacity is limited to some degree. And, there is risk of explosion when the steam producing device 2 is working.

SUMMARY OF THE INVENTION

It is a main object of the present invention to provide a steam producing device for use with a steam cleaning apparatus, in which water will go through dual heating processes, and which is free from the risk of explosion.

The steam producing device includes a strong outer shell, and a heating member inserted in, and secured to the outer shell. The heating member has a steam room, and forms a first, a second, and a third chamber together with the outer shell. The second chamber communicates with the first chamber owing to a gap, and communicates with the third chamber owing to a narrow curved passage provided between the heating member and the outer shell. A hole is formed on the heating member for the steam room to communicate with the third chamber. Thus, water and steam can travel through the chambers to go through one heating process, and then travel through the steam room to go through another heating process to be transformed into steam and discharged outside the shell for use after flowing into the first chamber; water and steam will undergo compression and expansion to have increased pressure when traveling through the gap and the narrow passage.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
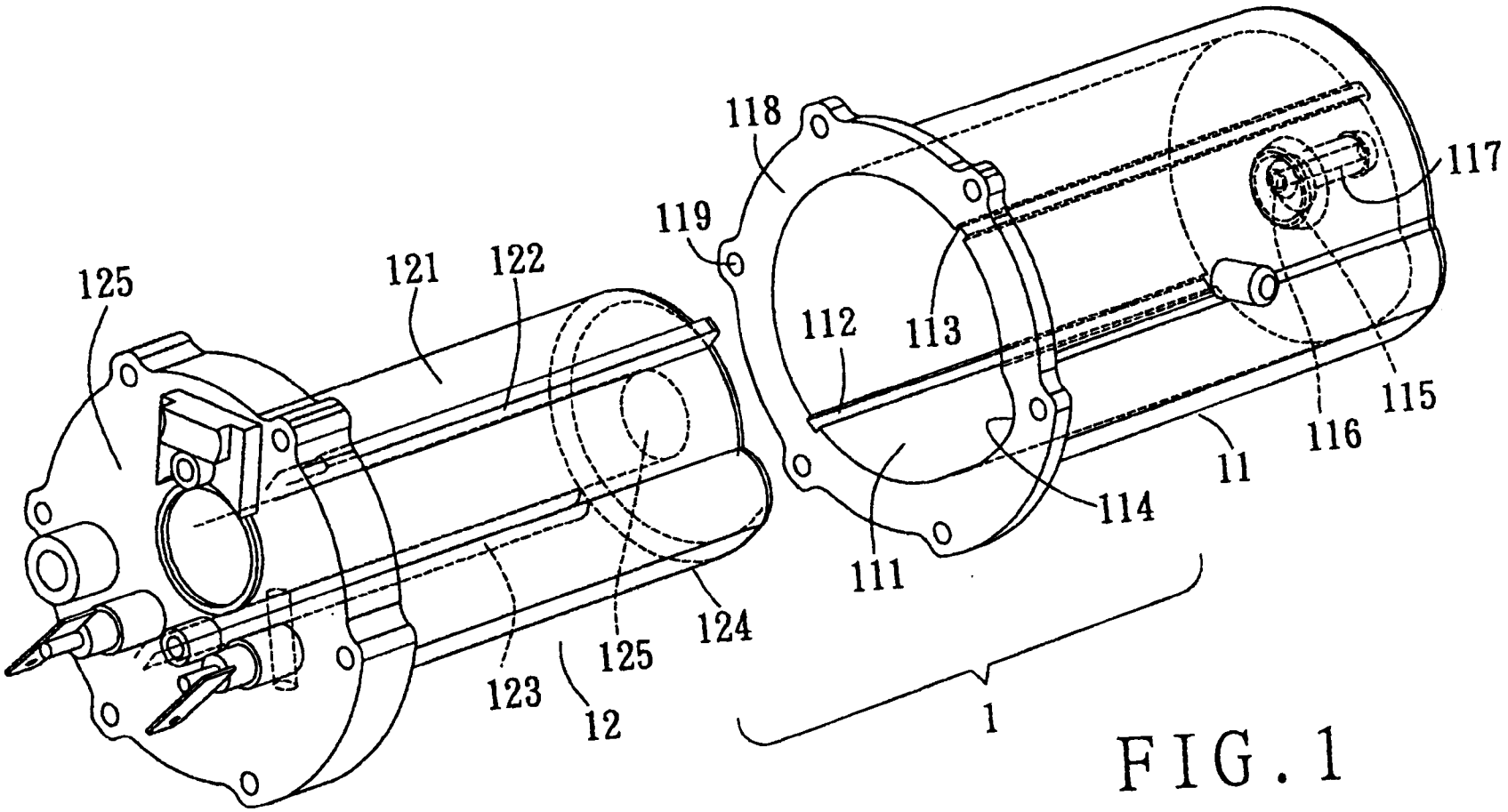
FIG. 1 is an exploded perspective view of the steam producing device according to the present invention.
Figure 2:
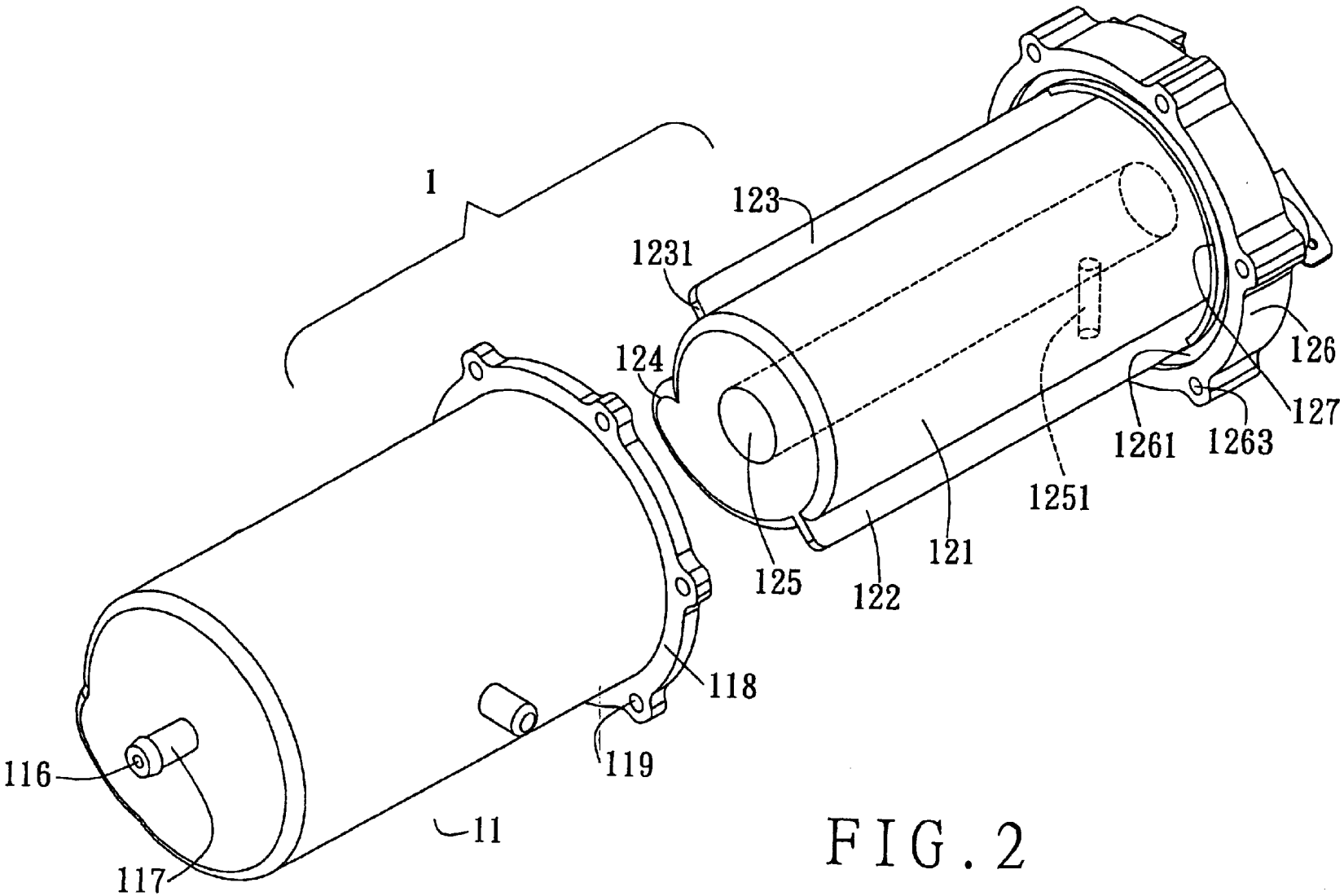
FIG. 2 is another exploded perspective view of the steam producing device according to the present invention.

Referring to FIGS. 1, and 2, a preferred embodiment of a steam producing device in the present invention includes an outer shell 11 and a heating member 12.

The outer shell 11 is relatively strong, and has a receiving opening at a head, a closed tail end, a holding room 111, positioning trenches 112 and 113 formed along an inner side, and a concavely curved recess 114 formed along the inner side. The outer shell 11 is further formed with a platform 115 on an inner side of the tail end thereof, and an outer conduit 117 projecting from an outer side of the tail end and in fluid communication with a through hole 116 of the platform 115. The head of the outer shell 11 has a rim 118, which is formed with fixing holes 119 thereon.

Figure 4:
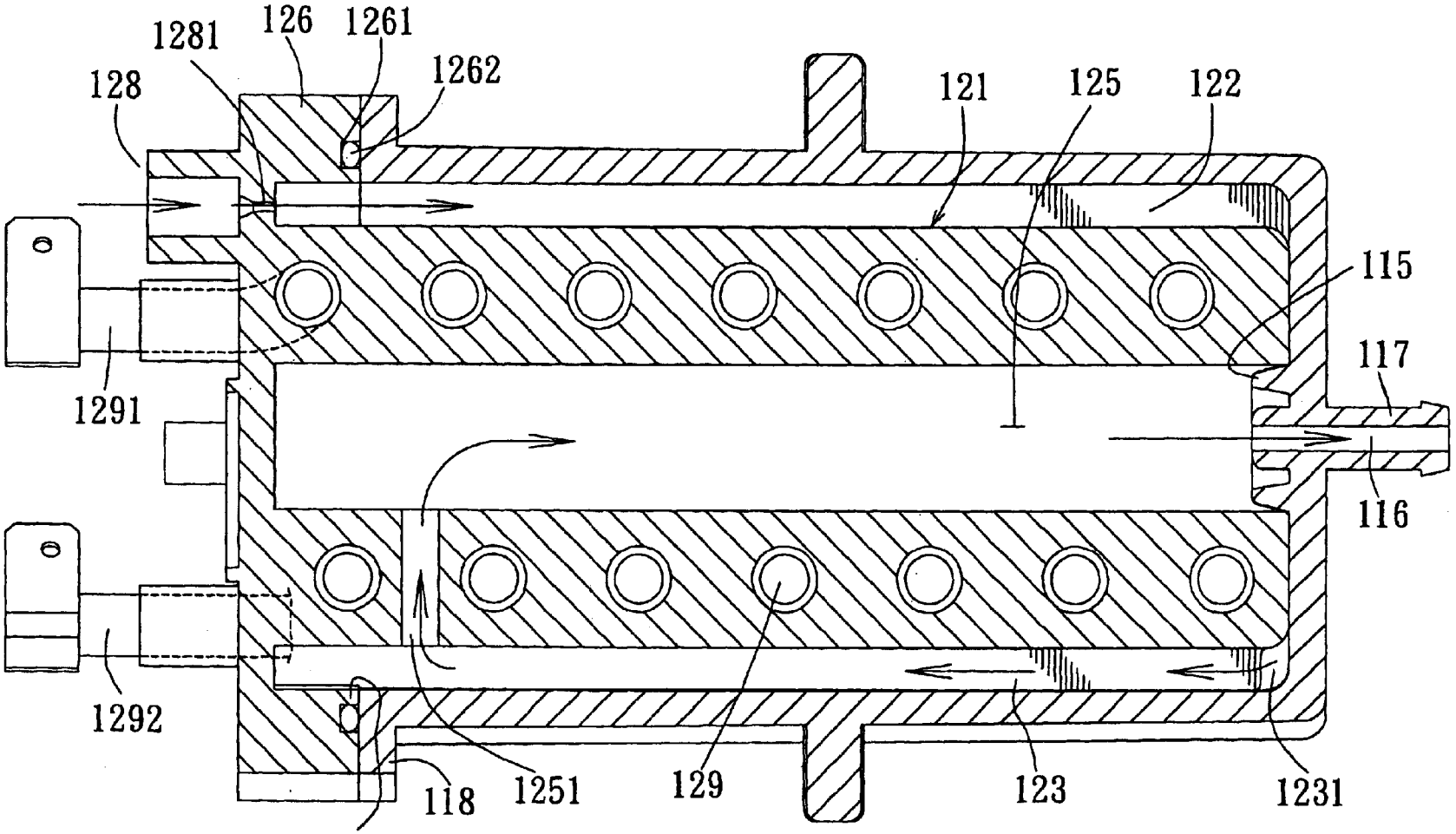
FIG. 4 is a cross-sectional view of the present steam producing device.

The heating member 12 has a heating section 121, elongated separating projections 122 and 123 formed along an outer side of the heating section 121, a convexly curved projection 124 along the outer side of the heating section 121, a steam room 125 extending from a head to a tail portion thereof, and a connecting hole 1251, which extends from the outer side to the steam room 125 for making the steam room 125 communicate with a space between the separating projection 122 and the convexly curved projection 124. In addition, a tail end of the separating projection 122 is co-planer with the tail end of the heating section 121 to block flow of water therethrough while a gap 1231 is formed on the tail ends of the separating projection 123 and the heating section 121, as shown in FIG. 4. In other words, the tail end of the separating projection 123 is not co-planer with the tail end of the heating section 121, and in turns, the first and the second chambers 13 and 14 communicate with each other. The head of the heating member 12 has a cap-shaped portion 126, and a curved bar 127 held in a space defined by the separating projections 122, 123 as well as an inner side of the cap-shaped portion 126; the cap-shaped portion 126 has a ringed portion 1261 on an inner side, and fixing holes 1263 thereon; a leak-prevention ring 1261 is disposed over the ringed portion 1261 of the cap-shaped portion 126.

Figure 3:
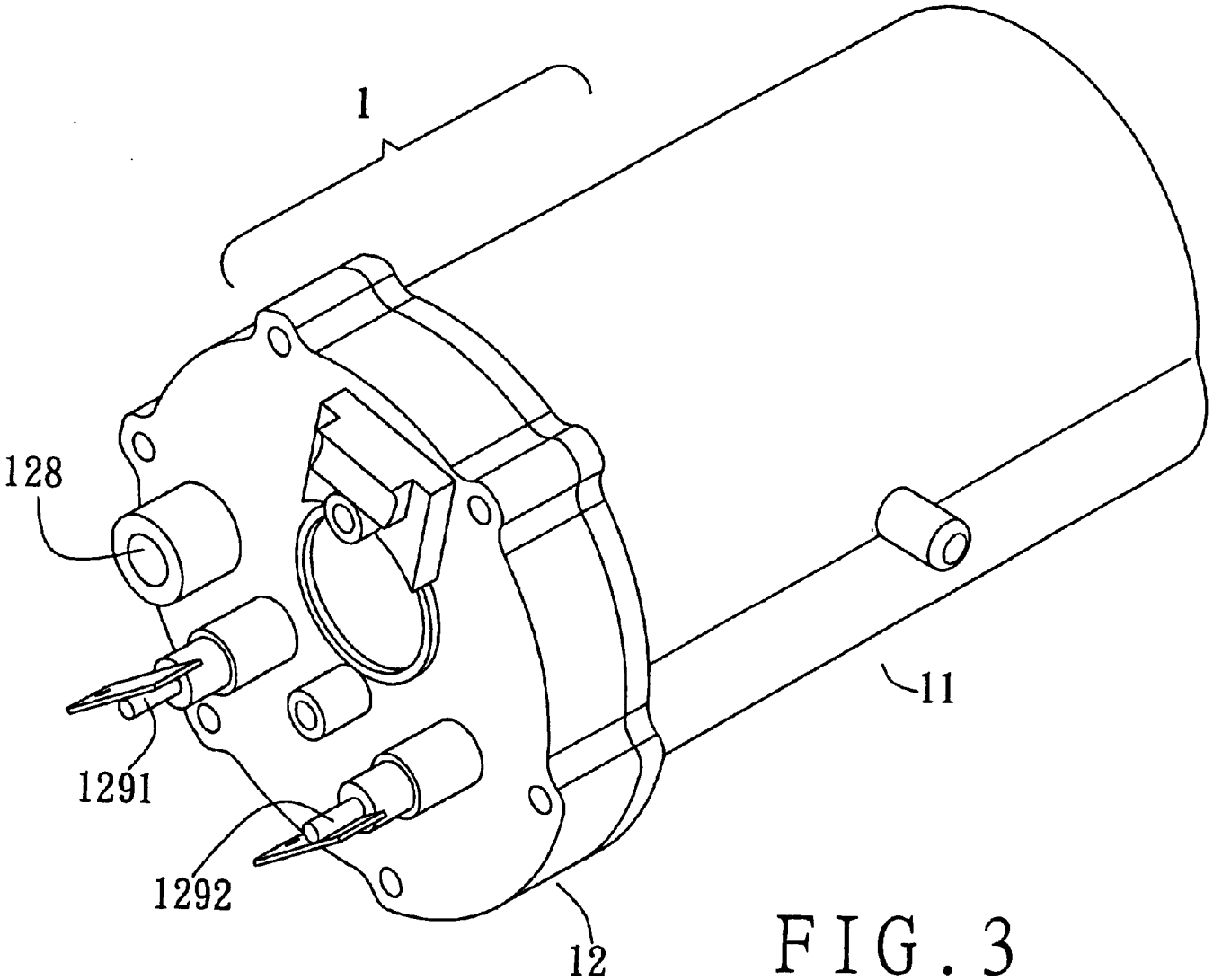
FIG. 3 is a perspective view of the present steam producing device.

Furthermore, referring to FIGS. 3, and 4, the cap-shaped portion 126 of the heating member 12 has a through hole 1281, an inlet duct 128 projecting around the through hole 1281 from an outward side thereof, and a pair of electricity conducting terminals 1291 and 1292 on the outward side thereof. And, referring to FIGS. 4, and 5, a heating pipe 129 is hidden in the heating member 12, and connected to the conducting terminals 1291, 1292 at two ends thereof so that it can be powered to produce heat; the heating pipe 129 is comprised of a coiled section, and a straight section, which are respectively hidden in the heating section 121, and hidden along the convexly curved projection 124.

Figure 5:
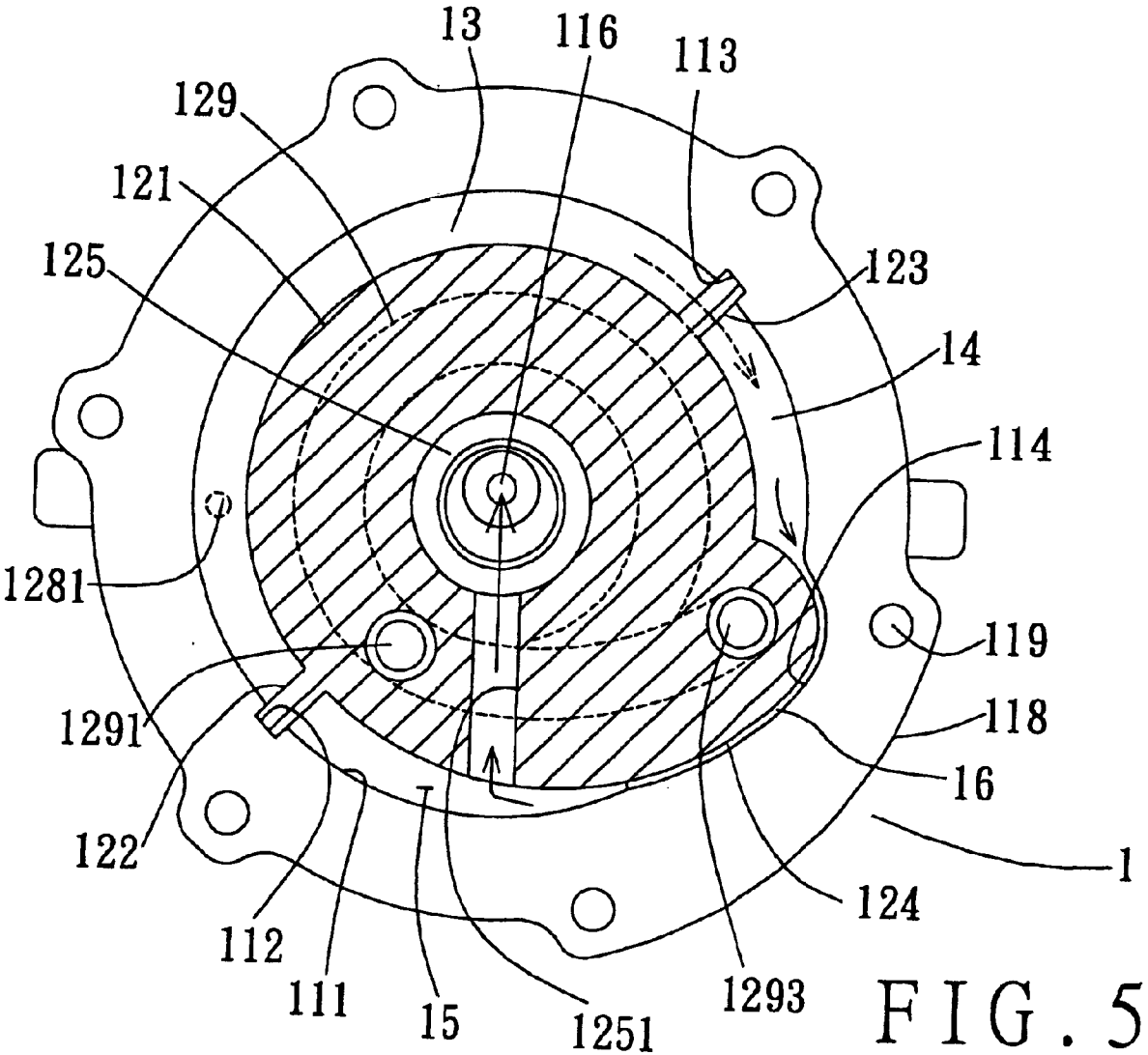
FIG. 5 is a view of inside of one end of the steam producing device according to the present invention.
Figure 6:
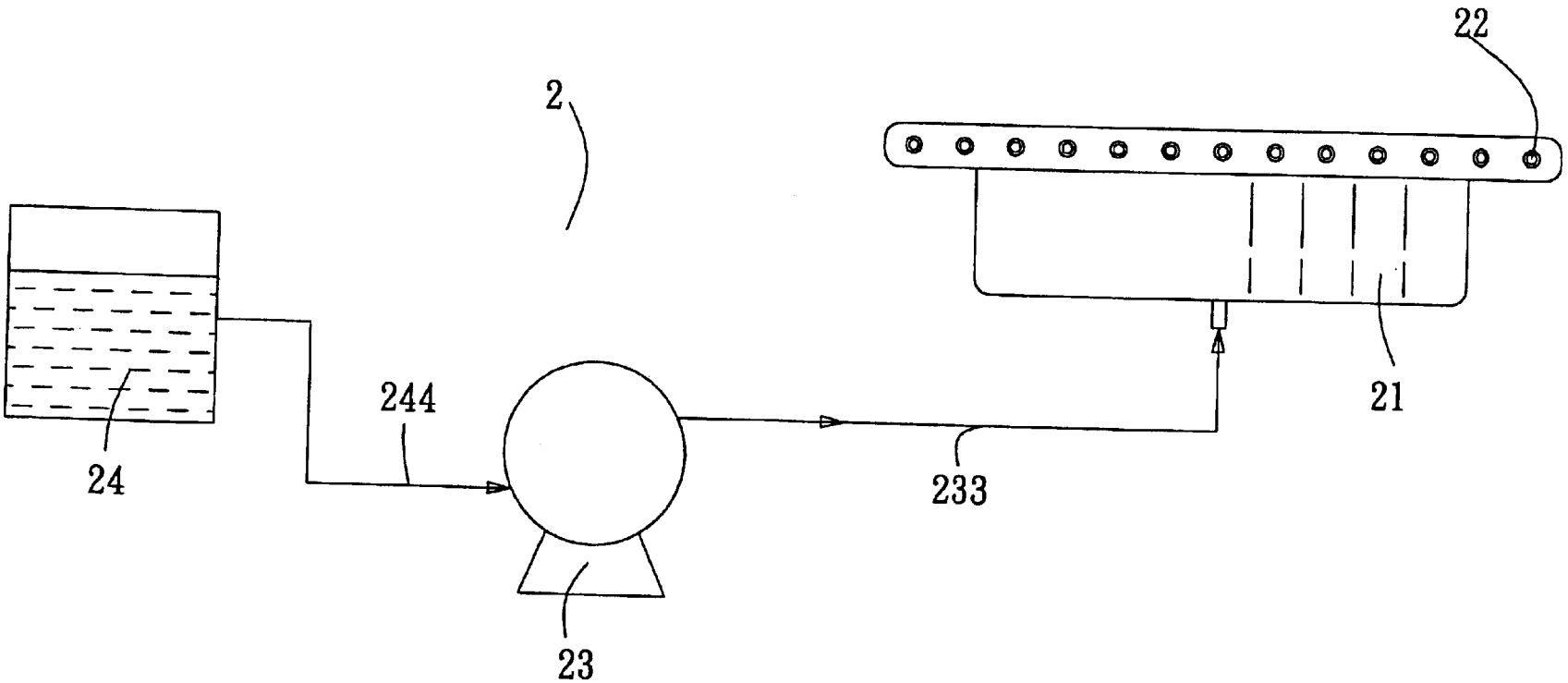
FIG. 6 (PRIOR ART)
FIG. 6 is a plan of the conventional steam producing device as described in the Background.
Figure 7:
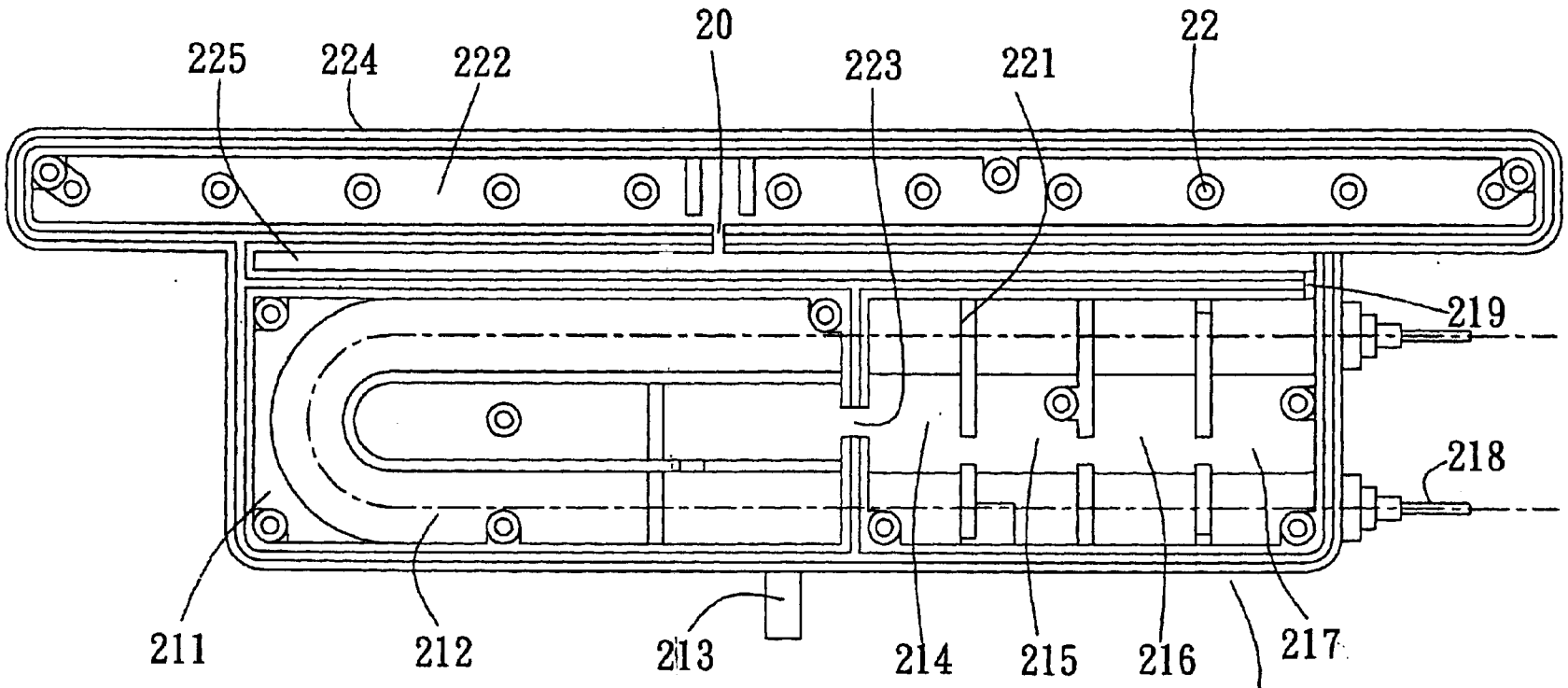
FIG. 7 (PRIOR ART)
FIG. 7 is a section of the conventional steam producing device.

In combination, the heating member 12 is inserted into the holding room 111 of the outer shell 11 with the separating projections 122, 123 being respectively closely fitted in the positioning trenches 112, 113, and with the convexly curved projection 123 being disposed in the concavely curved recess 114, and with the cap-shaped portion 126 abutting the rim 118 of the head of the outer shell 11; the convexly curved projection 124 is a short distance off the surface of the concavely curved recess 114 so that a narrow curved passage 16 is provided in between; threaded fixing elements (not shown) are screwed through the fixing holes 1263 and 119 to securely join the heating member 12 to the outer shell 11. And, the steam room 125 communicates with the ejection hole 116 of the tail end of the outer shell 11. Thus, a first chamber 13 is defied by means of the separating projections 122, 123, and the outer shell 11 while a second chamber 14 is defined by means of the separating projection 123, the convexly curved projection 124, and the outer shell 11. And, a third chamber 15 is defined by means of the separating projection 122, the convexly curved projection 124, and the outer shell 11, as shown in FIGS. 4, and 5. The second chamber 14 communicates with the first chamber 13 owing to the gap 1231, and communicates with the third chamber 15 owing to the narrow curved passage 16 while the steam chamber 125 communicates with the third chamber 15 owing to the connecting hole 1251.

In using the present steam producing device, water travels into the first chamber 13 via the inlet duct 128 and the through hole 1281, and is heated by the heating section 121, and then travels into the second chamber 14 via the gap 1231 to be heated by another portion of the heating section 121. Then, the water travels into the third chamber 15 via the narrow curved passage 16, and is heated by yet another portion of the heating section 121. Afterwards, the heated water travels into the steam chamber 125 via the connecting hole 1251, and is transformed into steam by means of heat from the heating pipe 129. Finally, the steam is discharged outside the present device via the ejection hole 116 and the outer conduit 117, which is connected to other devices so that the steam can be used or directed to suitable destinations.

From the above description, it can be easily understood that the steam producing device of the present invention has, as compared with the conventional one, advantages as followings:

1. Water and steam goes through one heating process in the chambers 13, 14, and 15, and goes through another heating process to become steam with high pressure and high temperature in the steam room 125.

Therefore, the present device is more efficient.

2. The gap 1231, and the narrow curved passage 16 are relatively small as compared with the chambers 13, 14, 15 therefore water and steam will undergo compression and expansion when traveling through the present device, and pressure of steam will be increased not only by heat from the heating pipe 129 but also by the compression and expansion.
3. Water has been heated near to boiling point with high temperature and pressure when traveling through the connecting hole 1251 therefore the water can be transformed into steam with high temperature and pressure, which steam is then ejected from the conduit 117. In other words, the present device can perform dual heating and pressure-increasing processes.
4. The outer shell 11 is relatively strong, and capable of preventing high-pressure steam from causing explosion of the present device therefore the present device is safe to use.
5. The gap 1231, and the narrow curved passage 16 are so small as to help steam of high temperature and pressure to be smoothly ejected, and prevent water from being discharged outside the device that has not been completely transformed into steam.

What is claimed is:

1. A steam producing device capable of performing dual heating processes, comprising an outer shell having a receiving opening at a head, and a generally closed tail end; the tail end having a platform formed with an ejection hole, and a conduit projecting from an outer side and communicating with the ejection hole; the outer shell having first and second positioning trenches, and a concavely curved recess along an inner side thereof; the head of the outer shell having a rim formed with fixing holes; and a heating member, the heating member having a heating section inserted into the outer shell; the heating member having first and second elongated separating projections and a convexly curved projection along an outer side of the heating section; the elongated separating projections being closely fitted in respective positioning trenches of the outer shell with the convexly curved projection being received in the concavely curved recess such that a first chamber is defined by the first and the second separating projections and the outer shell, and such that a second chamber is defined by the second separating projection, the convexly curved projection, and the outer shell, and such that a third chamber is defined by the first separating projection, the convexly curved projection, and the outer shell; the heating member having a heating pipe hidden therein; the heating section having a steam room lengthwise extending therein from a head to a tail end thereof and communicating with the ejection hole of the outer shell tail end;

the heating member having a cap at the head; the cap being provided with an water inlet duct communicating with the first chamber; the cap being provided with a pair of electricity conducting terminals connected to respective ones of two ends of the heating pipe; the cap having a ringed portion on an inner side; a leak-prevention ring being disposed over the ringed portion of the cap to be sandwiched between the cap and the rim; the cap being secured to the rim by means of screwing threaded fixing elements into fixing holes of the cap and the fixing holes of the rim;

a tail end of the first separating projection being co-planer with the tail end of the heating section to block flow of water therethrough; a gap being formed on a tail end of the second separating projection for the first and the second chambers to communicate with each other; the convexly curved projection being a short distance off a surface of the concavely curved recess such that a curved passage is formed in between for the second and the third chambers to communicate with each other; the heating section being formed with a connecting hole for the steam room to communicate with the third chamber;

thus, water being capable of traveling through the first, the second, and the third chambers in sequence to go through one heating process, and then traveling through the steam room to go through another heating process to be transformed into steam and discharged outside via the ejection hole after flowing into the first chamber via the inlet conduit.

2. The steam producing device capable of performing dual heating processes as claimed in claim 1, wherein the heating pipe includes a coiled section, and a straight section, which are respectively hidden in the heating section, and hidden along the convexly curved projection.

* * * * *